United States Patent [19]

Cheung

[11] Patent Number: 4,594,085

[45] Date of Patent: Jun. 10, 1986

[54] HYBRID NITROGEN GENERATOR WITH AUXILIARY REBOILER DRIVE

[75] Inventor: Harry Cheung, Kenmore, N.Y.

[73] Assignee: Union Carbide Corporation, Danbury, Conn.

[21] Appl. No.: 671,939

[22] Filed: Nov. 15, 1984

[51] Int. Cl.[4] ..... F25J 3/04

[52] U.S. Cl. ..... 62/25; 62/28; 62/29; 62/31; 62/34; 62/38

[58] Field of Search ..... 62/38, 39, 24, 25, 27, 62/28, 29, 31, 34

[56] References Cited

U.S. PATENT DOCUMENTS

| | | | |
|---|---|---|---|
| 3,518,839 | 7/1970 | Becker | 62/13 |
| 4,017,276 | 4/1977 | Bloem | 55/51 |
| 4,382,366 | 5/1983 | Gaumer | 62/39 |
| 4,400,188 | 8/1983 | Patel et al. | 62/13 |
| 4,464,188 | 8/1984 | Agrawal et al. | 62/13 |

*Primary Examiner*—Frank Sever

*Attorney, Agent, or Firm*—Stanley Ktorides

[57] ABSTRACT

A single column process to produce nitrogen at relatively high purity and yield by the cryogenic rectification of air employing multiple defined feeds to the column to allow for increased product removal off the top of the column while avoiding the need to recycle withdrawn nitrogen.

13 Claims, 4 Drawing Figures

HYBRID NITROGEN GENERATOR WITH AUXILIARY REBOILER DRIVE

TECHNICAL FIELD

This invention relates generally to the field of cryogenic distillative air separation and more particularly is an improvement whereby nitrogen may be produced at relatively high purity and at high recovery without the need to recycle withdrawn nitrogen.

BACKGROUND OF THE INVENTION

Nitrogen at relatively high purities is finding increasing usage in such applications as for blanketing, stirring or inerting purposes in such industries as glass and aluminum production, and in enhanced oil or natural gas recovery. Such applications consume large quantities of nitrogen and thus there is a need to produce relatively high purity nitrogen at high recovery and at relatively low cost.

Capital costs are kept low by employing a single column rather than a double column air separation process. Operating costs are reduced by energy efficient operation. Since a large part of the power required by the air separation process is consumed by the feed air compressor, it is desirable to recover as product as much of the feed air as is practical. Furthermore, it is desirable to avoid the inefficiency resulting from separating air into its components but then recycling some of the separated component.

It is therefore an object of this invention to provide an improved air separation process for the cryogenic distillative separation of air.

It is another object of this invention to provide an improved air separation process for the cryogenic separation of air which can produce nitrogen at relatively high purity and relatively high yield.

It is a further object of this invention to provide an improved single column air separation process for the cryogenic separation of air which can produce nitrogen at relatively high purity and relatively high yield.

It is a still further object of this invention to provide an improved single column air separation process for the cryogenic separation of air while avoiding the need to employ a nitrogen recycle stream.

SUMMARY OF THE INVENTION

The above and other objects which will become apparent to one skilled in the art upon a reading of this disclosure are attained by this invention which comprises:

A process for the production of nitrogen at relatively high yield and purity by cryogenic rectification of feed air comprising:

(1) introducing the major portion of the feed air into a rectification column which is operating at a pressure in the range of from 35 to 145 psia, and wherein feed air is separated into nitrogen-rich vapor and oxygen-enriched liquid;

(2) condensing a minor portion of the feed air, at a pressure greater than that at which the column is operating, by indirect heat exchange with oxygen-enriched liquid;

(3) introducing the resulting condensed minor portion of the feed air into the column at a point at least one tray above the point where the major portion of the feed air is introduced into the column;

(4) condensing a first portion of the nitrogen-rich vapor by indirect heat exchange with vaporizing oxygen-enriched liquid;

(5) passing at least some of the resulting condensed nitrogen-rich portion to the column at a point at least one tray above the point where the minor portion of the feed air is introduced into the column; and (6) recovering substantially the entire remaining second portion of the nitrogen-rich vapor as product nitrogen.

The term, "column", as used in the present specification and claims means a distillation or fractionation column or zone, i.e., a contacting column or zone wherein liquid and vapor phases are countercurrently contacted to effect separation of a fluid mixture, as for example, by contacting of the vapor and liquid phases on a series or vertically spaced trays or plates mounted within the column or alternatively, on packing elements with which the column is filled. For a further discussion of distillation columns see the Chemical Engineers' Handbook. Fifth Edition, edited by R. H. Perry and C. H. Chilton, McGraw-Hill Book Company, New York, Section 13, "Distillation" B. D. Smith et al, page 13-3, *The Continuous Distillation Process.* The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation. Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns.

The term "indirect heat exchange", as used in the present specification and claims, means the bringing of two fluid streams into heat exchange relation without any physical contact or intermixing of the fluids with each other.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element equivalent to one height equivalent of a theoretical plate (HETP).

DETAILED DESCRIPTION

The process of this invention will be described in detail with reference to the drawings.

Figure 1:
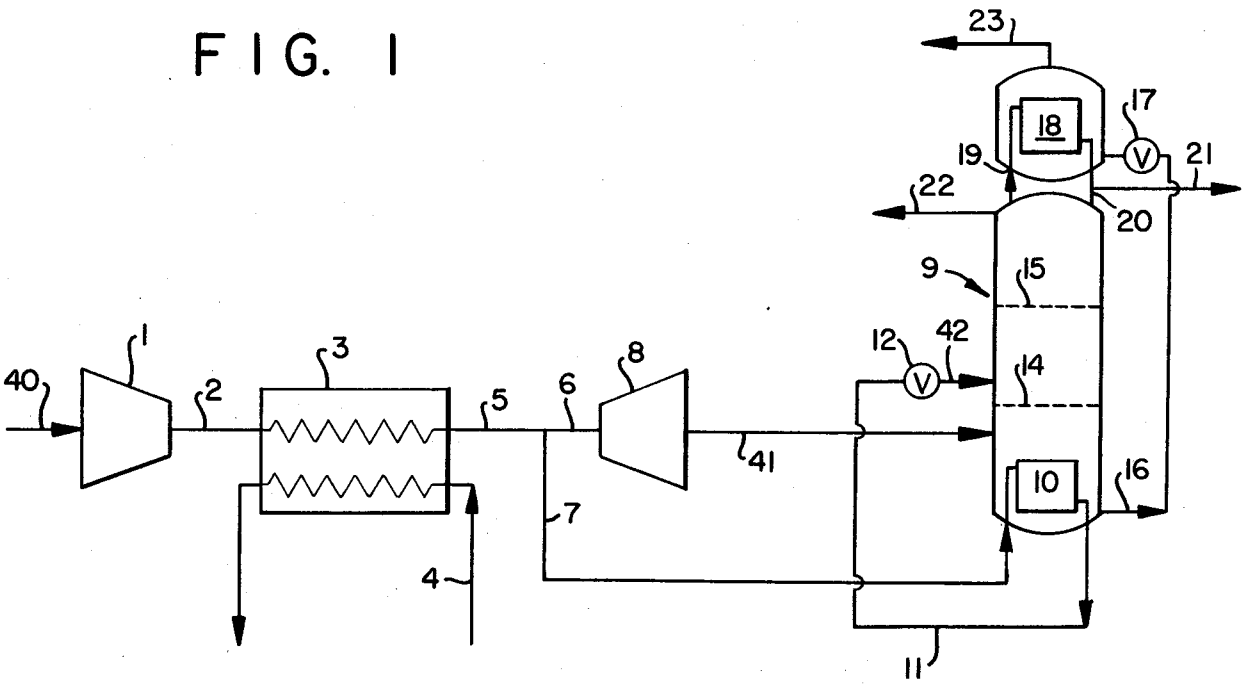
FIG. 1 is a schematic representation of a simplified version of an air separation process showing the essential elements of a preferred embodiment of the process of this invention.

Referring now to FIG. 1, feed air 40 is compressed in compressor 1 and the compressed feed air stream 2 is cooled in heat exchanger 3 by indirect heat exchange with stream or streams 4 which may conveniently be return stream(s) from the air separation process. Impurities such as water and carbon dioxide may be removed by any conventional method such as reversing heat exchange or adsorption.

The compressed and cooled feed air 5 is divided into major portion 6 and minor portion 7. Major portion 6 may comprise from about 55 to 90 percent of the total feed air and preferably comprises from about 60 to 90 percent of the feed air. Minor portion 7 may comprise from about 10 to 45 percent of the total feed air, preferably comprises from about 10 to 40 percent of the feed air and most preferably comprises from about 15 to 35 percent of the feed air.

Major portion 6 is expanded through turboexpander 8 to produce refrigeration for the process and expanded stream 41 is introduced into column 9 operating at a pressure in the range of from about 35 to 145 pounds per square inch absolute (psia), preferably from about 40 to 100 psia. Below the lower pressure range limit the requisite heat exchange will not work effectively and above the upper pressure range limit minor portion 7 requires excessive pressure. The major portion of the feed air is introduced into column 9. Within column 9, feed air is separated by cryogenic rectification into nitrogen-rich vapor and oxygen-enriched liquid.

Minor portion 7 is passed to condenser 10 at the base of column 9 wherein it is condensed by indirect heat exchange with oxygen-enriched liquid which vaporizes to produce stripping vapor for the column. The resulting condensed minor portion 11 is expanded through valve 12 and introduced as stream 42 into column 9 at a point at least one tray above the point where the major portion of the feed air is introduced into the column. In FIG. 1, tray 14 is above the point where stream 41 is introduced into column 9 and stream 42 is shown as being introduced into column 9 above tray 14. The liquefied minor portion introduced into column 9 serves as liquid reflux and undergoes separation by cryogenic rectification into nitrogen-rich vapor and oxygen-enriched liquid.

As indicated, the minor portion of the feed air passing through condenser 10 is at a higher pressure than that at which column 9 is operating. This is required in order to vaporize oxygen-enriched liquid at the bottom of the column because this liquid has a higher concentration of oxygen than does the feed air. Generally, the pressure of the minor portion will be from 10 to 90 psi, preferably from 15 to 60 psi, above that pressure at which the column is operating.

Thus it is seen that the pressure of the minor feed air portion entering condenser 10 exceeds that of the major feed air portion entering column 9. FIG. 1 illustrates a preferred way to achieve this pressure differential wherein the entire feed air stream is compressed and then the major portion is turboexpanded to provide plant refrigeration prior to introduction into column 9. Alternatively, only the minor feed air portion could be compressed to the requisite pressure exceeding the column operating pressure. In this situation, plant refrigeration may be provided by expansion of a return waste or product stream. In yet another variation, some plant refrigeration may be provided by an expanded major feed air portion and some by an expanded return stream.

As mentioned previously, the feed air in column 9 is separated into nitrogen-rich vapor and oxygen-enriched liquid. A first portion 19 of the nitrogen-rich vapor is condensed in condenser 18 by indirect heat exchange with oxygen-enriched liquid which is taken from the bottom of column 9 as stream 16, expanded through valve 17 and introduced to the boiling side of condenser 18. The oxygen-enriched vapor which results from this heat exchange is removed as stream 23. This stream may be expanded to produce plant refrigeration, recovered in whole or in part, or simply released to the atmosphere. The condensed first nitrogen-rich portion 20 resulting from this overhead heat exchange is passed, at least in part, to column 9 as liquid reflux at a point at least one tray above the point where the minor portion of the feed air is introduced into column 9. In FIG. 1, tray 15 is above the point where stream 42 is introduced into column 9, and stream 20 is shown as being introduced into column 9 above tray 15. If desired, a part 21 of stream 20 may be removed and recovered as high purity liquid nitrogen. If employed, part 21 is from about 1 to 10 percent of stream 20.

Substantially the entire remaining second portion 22 of the nitrogen-rich vapor is removed from the column and recovered as product nitrogen without recycling a portion back to the column. The product nitrogen has a purity of at least 98 mole percent and can have a purity up to 99.9999 mole percent or 1 ppm oxygen contaminant. The product nitrogen is recovered at high yield. Generally the product nitrogen, i.e., the nitrogen recovered in stream 22 and in stream 21 if employed, will be at least 50 percent of the nitrogen introduced into column 9 with the feed air, and typically is at least 60 percent of the feed air nitrogen. The nitrogen yield may range up to about 82 percent.

Figure 2:
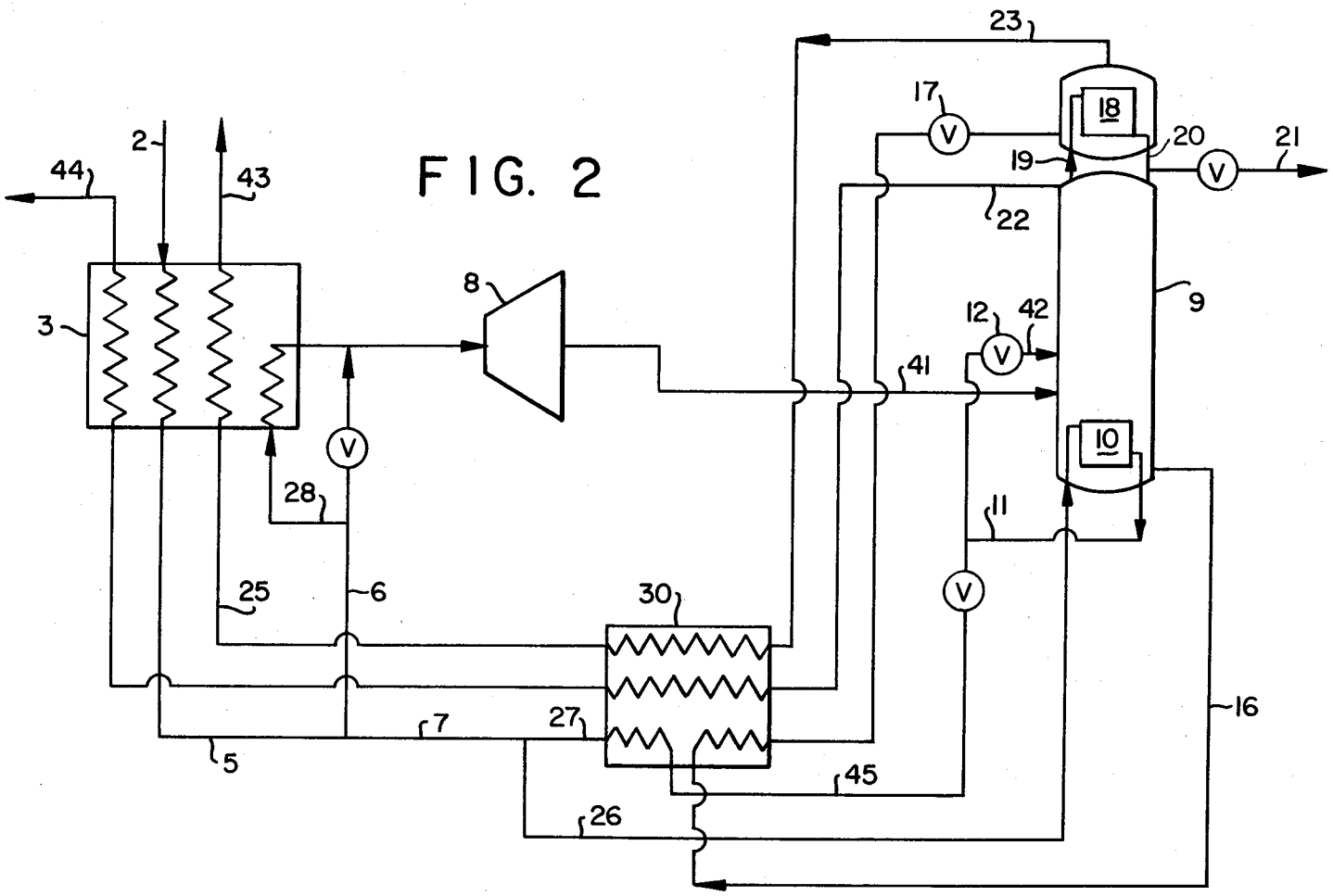
FIG. 2 is a schematic representation of an air separation process employing a preferred embodiment of the process of this invention.

FIG. 2 illustrates a comprehensive air separation plant which employs a preferred embodiment of the process of this invention. The numerals of FIG. 2 correspond to those of FIG. 1 for the equivalent elements. Referring now to FIG. 2, compressed feed air 2 is cooled by passage through reversing heat exchanger 3 against outgoing streams. High boiling impurities in the feed stream, such as carbon dioxide and water, are deposited on the passages of reversing heat exchanger 3. As is known to those skilled in the art, the passages through which feed air passes are alternated with those of outgoing stream 25 so that the deposited impurities may be swept out of the heat exchanger. Cooled, cleaned and compressed air stream 5 is divided into major portion 6 and minor portion 7. All or most of minor stream 7 is passed as stream 26 to condenser 10. A small part 27 of minor portion 7 may bypass condenser 10 to satisfy a heat balance as will be more fully described later. As previously described with reference to FIG. 1, minor feed stream 26 is condensed in condenser 10 by evaporating column bottoms, the liquefied air 11 is expanded through value 12 to the column operating pressure, and introduced 42 into column 9.

The major portion 6 of the feed air is passed to expansion turbine 8. A side stream 28 of portion 6 is passed partially through reversing heat exchanger 3 for heat balance and temperature profile control of this heat exchanger in a manner well known to those skilled in the art. The side stream 28 is recombined with stream 6 and, after passage through expander 8, the major feed air portion is introduced into column 9.

Oxygen-enriched liquid collecting in the base of column 9 is withdrawn as stream 16, cooled by outgoing streams in heat exchanger 30, expanded through valve 17 and introduced to the boiling side of condenser 18 where it vaporizes against condensing nitrogen-rich vapor introduced to condenser 18 as stream 19. The resulting oxygen-enriched vapor is withdrawn as stream 23, passed through heat exchangers 30 and 3 and exits the process as stream 43. Nitrogen-rich vapor is withdrawn from column 9 as stream 22, passed through heat exchangers 30 and 3 and recovered as stream 44 as product nitrogen. The condensed nitrogen 20 resulting from the overhead heat exchange is passed into column 9 as reflux. A part 21 of this liquid nitrogen may be recovered.

Small air stream 27 is subcooled in heat exchanger 30 and this heat exchanger serves to condense this small stream. The resulting liquid air 45 is added to air stream 11 and introduced into column 9. The purpose of this small liquid air stream is to satisfy the heat balance around the column and in the reversing heat exchanger. This extra refrigeration is required to be added to the column if the production of a substantial amount of liquid nitrogen product is desired. In addition the air stream 27 is used to warm the return streams in heat exchanger 30 so that no liquid air is formed in reversing heat exchanger 3. Stream 27 generally is less than 10 percent of the total feed air to the column and those skilled in the art can readily determine the magnitude of stream 27 by employing well known heat balance techniques.

Figure 3:
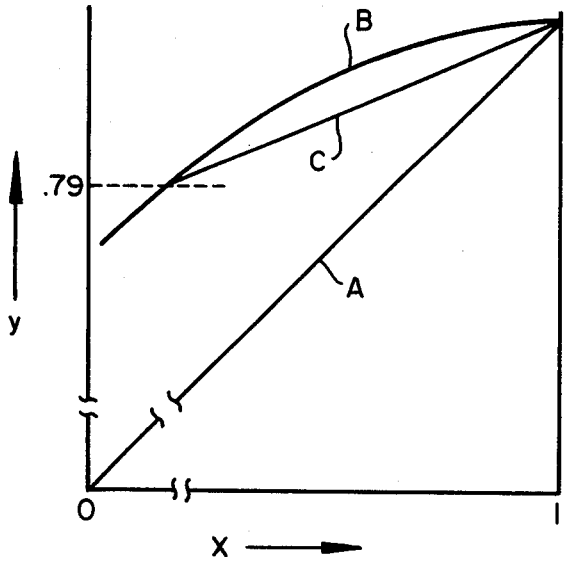
FIG. 3 (PRIOR ART)
FIG. 3 is a representative McCabe-Thiele diagram for a conventional single column air separation process.
Figure 4:
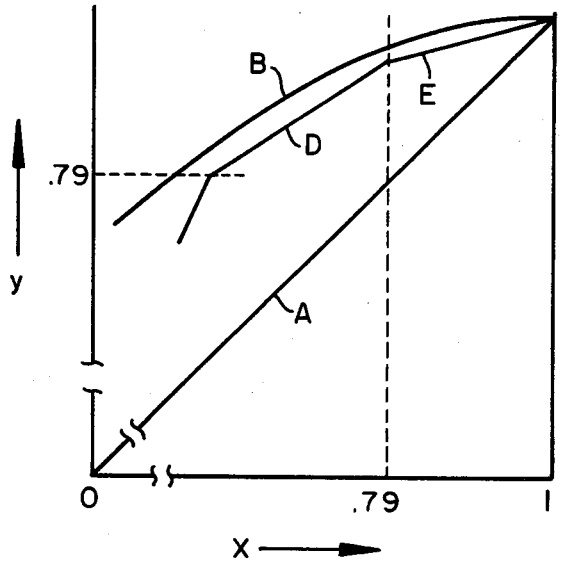
FIG. 4 is a representative McCabe-Thiele diagram for the process of this invention.

The manner in which the process of this invention can achieve the increased recovery of nitrogen can be demonstrated with reference to FIGS. 3 and 4 which are McCabe-Thiele diagrams respectively for a conventional single column air separation process and for the process of this invention. McCabe-Thiele diagrams are well known to those skilled in the art and a further discussion of McCabe-Thiele diagrams may be found, for example, in *Unit Operations of Chemical Engineering*, McCabe and Smith, McGraw-Hill Book Company, New York, 1956, Chapter 12, pages 689–708.

In FIGS. 3 and 4, the abscissa represents the mole fraction of nitrogen in the liquid phase and the ordinate represents the mole fraction of nitrogen in the vapor phase. Curve A is the locus of points where x equals y. Curve B is the equilibrium line for oxygen and nitrogen at a given pressure. As is known to those skilled in the art, the minimum capital cost, i.e. the smallest number of theoretical stages to achieve a given separation, is represented by an operating line, which is the ratio of liquid to vapor at each point in the column, coincident with curve A; that is, by having total reflux. Of course, no product is produced at total reflux. Minimum possible operating costs are limited by the line including the final product purity on Curve A and the intersection of the feed condition and equilibrium line. The operating line for minimum reflux for a conventional column is given by Curve C of FIG. 3. Operation at minimum reflux would produce the greatest amount of product, that is, highest recovery, but would require an infinite number of theoretical stages. Real systems are operated between the extremes described above.

The capability for high nitrogen recovery of the process of this invention is shown in FIG. 4. Referring now to FIG. 4, section D of the operating line represents that portion of the column between the major and minor air feeds, and section E represents that portion of the column above the minor air feed. The smaller slope of section E indicates that less liquid reflux is required in the top most portion of the column, so more nitrogen can be taken off as product. The introduction of the minor air feed into the column as liquid at a nitrogen concentration of 79 percent gives a better shape to the operating line, relative to the equilibrium line, permitting the smaller slope of section E.

As previously indicated, the flowrate of the minor air feed is from 10 to 45 percent, preferably from 10 to 40 percent of the total air feed. The minor air feed flowrate must at least equal the minimum flowrate recited in order to realize the benefit of enriched oxygen waste and, therefore, increased recovery. A minor air feed flowrate exceeding the maximum recited increases compression costs and causes excessive reboiling without significant additional enhancement of separation. Where refrigeration is produced by expansion of the major air stream, a higher level pressure is required to achieve the same refrigeration generation. Where the minor air stream undergoes booster compression, power costs increase with flowrate. The ranges recited for the minor air stream take advantage of the benefits of this cycle without incurring offsetting disadvantages in efficiency.

Table I tabulates the results of a computer simulation of the process of this invention carried out in accord with the embodiment illustrated in FIG. 2. The stream numbers correspond to those of FIG. 2. The abbreviation mcfh means thousands of cubic feet per hour at standard conditions. The values given for oxygen concentration include argon.

TABLE I

| Stream No. | Flow (mcfh) | $O_2$ (mole percent) | $N_2$ (mole percent) | Temp (°K.) | Pressure (PSIA) |
|---|---|---|---|---|---|
| 2 | 174 | 22 | 78 | 300 | 80 |
| 6 | 112 | 22 | 78 | 100 | 74 |
| 7 | 56 | 22 | 78 | 100 | 74 |
| 16 | 74 | 51 | 49 | 94 | 46 |
| 22 | 100 | 0.02 | 99.98 | 88 | 44 |
| 23 | 74 | 51 | 49 | 87 | 16 |
| 26 | 56 | 22 | 78 | 100 | 74 |
| 27 | 7 | 22 | 78 | 100 | 74 |

By the use of the process of this invention which includes the defined introduction of feed streams to a fractionation column, one is able to produce relatively high purity nitrogen at high recovery, without starving the fractionation column of required reflux, and avoiding the need to recycle withdrawn nitrogen.

Although the process of this invention has been described in detail with reference to certain preferred embodiments, it can be appreciated that there are other embodiments of this invention which are within the spirit and scope of the claims.

I claim:

1. A process for the production of nitrogen at relatively high yield and purity by cryogenic rectification of feed air comprising avoiding the need to employ a nitrogen recycle stream by the steps of:

(a) introducing the major portion of the feed air into a rectification column which is operating at a pressure in the range of from 35 to 145 psia, and wherein feed air is separated into nitrogen-rich vapor and oxygen-enriched liquid;

(b) condensing a minor portion of the feed air, at a pressure greater than that at which the column is operating, by indirect heat exchange with oxygen-enriched liquid;

(c) introducing the resulting condensed minor portion of the feed air into the column at a point at least one tray above the point where the major portion of the feed air is introduced into the column;

(d) condensing a first portion of the nitrogen-rich vapor by indirect heat exchange with vaporizing oxygen-enriched liquid;

(e) passing at least some of the resulting condensed nitrogen-rich portion to the column at a point at least one tray above the point where the minor portion of the feed air is introduced into the column; and (f) recovering substantially the entire remaining second portion of the nitrogen-rich vapor as product nitrogen precluding the need for substantial recycle of any portion thereof back to the distillation column.

2. The process of claim 1 wherein said major portion comprises from about 55 to 90 percent of the feed air and said minor portion comprises from about 10 to 45 percent of the feed air.

3. The process of claim 1 wherein said major portion comprises from about 60 to 90 percent of the feed air and said minor portion comprises from about 10 to 40 percent of the feed air.

4. The process of claim 1 wherein the minor portion of the feed air is at a pressure in the range of from 10 to 90 psi above the pressure at which the rectification column is operating, during the condensation of step (b).

5. The process of claim 1 wherein all of the condensed nitrogen-rich first portion is passed to the column.

6. The process of claim 1 wherein some of the condensed nitrogen-rich first portion is recovered as product liquid nitrogen.

7. The process of claim 1 wherein the entire feed air is compressed to a pressure greater then the operating pressure of the column and the major portion of the feed air is expanded to the operating pressure of the column prior to its introduction into the column.

8. The process of claim 7 wherein the expansion of the feed air generates refrigeration for the process.

9. The process of claim 1 wherein only the minor portion of the feed air is compressed to a pressure greater than the operating pressure of the column.

10. The process of claim 1 wherein a third portion of the feed air is condensed by indirect heat exchange with at least one return stream and the resulting condensed third portion is introduced into the column at a feed point at least one tray above the point where the major portion of the feed air is introduced into the column.

11. The process of claim 10 wherein the condensed third portion is combined with the condensed minor portion and the combined stream is introduced into the column.

12. The process of claim 1 wherein the product nitrogen has a purity of at least 98 mole percent.

13. The process of claim 1 wherein the product nitrogen is at least 50 percent of the nitrogen introduced into the column with the feed air.

* * * * *